US009108310B2

(12) United States Patent
Thull

(10) Patent No.: US 9,108,310 B2
(45) Date of Patent: Aug. 18, 2015

(54) FUELDRAULIC ACTUATOR INSTALLATION AND REMOVAL TOOL

(75) Inventor: Zachariah Thull, Lexington Park, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 889 days.

(21) Appl. No.: 13/349,625

(22) Filed: Jan. 13, 2012

(65) Prior Publication Data

US 2013/0180093 A1 Jul. 18, 2013

(51) Int. Cl.
*B25B 27/14* (2006.01)

(52) U.S. Cl.
CPC ..... *B25B 27/14* (2013.01); *Y10T 29/53913* (2015.01)

(58) Field of Classification Search
USPC ..... 29/271; 254/126; 269/17, 71, 75, 60
See application file for complete search history.

(56) References Cited

U.S. PATENT DOCUMENTS

| | | | | | |
|---|---|---|---|---|---|
| 289,861 | A * | 12/1883 | Schrepel | ..... | 12/111 |
| 2,153,941 | A * | 4/1939 | Smith | ..... | 29/222 |
| 2,585,158 | A * | 2/1952 | Morgenthaler | ..... | 72/392 |
| 4,234,174 | A * | 11/1980 | Cardono | ..... | 269/37 |
| 4,749,169 | A * | 6/1988 | Pickles | ..... | 254/122 |
| 4,770,025 | A * | 9/1988 | Graf | ..... | 72/422 |
| 4,919,382 | A * | 4/1990 | Forman | ..... | 248/178.1 |
| 5,285,704 | A * | 2/1994 | Santana Gonzalez | ..... | 81/484 |
| 5,924,665 | A * | 7/1999 | Sweere et al. | ..... | 248/285.1 |
| 5,933,935 | A * | 8/1999 | Alcorn | ..... | 29/229 |
| 6,779,278 | B1 * | 8/2004 | Spady et al. | ..... | 33/569 |
| 6,786,896 | B1 * | 9/2004 | Madhani et al. | ..... | 606/1 |
| 7,032,287 | B1 * | 4/2006 | Spady et al. | ..... | 29/559 |
| 7,753,629 | B1 * | 7/2010 | McCulloch | ..... | 409/224 |
| 8,333,526 | B2 * | 12/2012 | Long | ..... | 403/57 |
| 8,795,387 | B1 * | 8/2014 | Razink | ..... | 623/62 |
| 8,807,532 | B2 * | 8/2014 | Horwath et al. | ..... | 254/92 |
| 2009/0176015 | A1 * | 7/2009 | Nakanishi et al. | ..... | 427/162 |
| 2010/0065795 | A1 * | 3/2010 | Christie | ..... | 254/126 |

* cited by examiner

*Primary Examiner* — Monica Carter
*Assistant Examiner* — Mahdi H Nejad
(74) *Attorney, Agent, or Firm* — Mark O. Glut; NAWCAD

(57) ABSTRACT

A fueldraulic actuator installation and removal tool that includes a base, an actuator chassis, and at least one articulating arm. The actuator chassis is able to communicate with a jet fueldraulic actuator located in a jet engine bay such that the actuator can be removed from the jet engine bay. The actuator chassis is connectable to the actuator at three predetermined points on the actuator. The at least one articulating arm, which is attached to the base, communicates with the actuator chassis such that the actuator chassis can be moved forward (frontwards) and backwards and left and right, and oriented at different inclines and adjusted to allow the actuator chassis to align and interface with the jet fueldraulic actuator.

9 Claims, 3 Drawing Sheets

FUELDRAULIC ACTUATOR INSTALLATION AND REMOVAL TOOL

STATEMENT OF GOVERNMENT INTEREST

The invention described herein may be manufactured and used by or for the Government of the United States of America for governmental purposes without payment of any royalties thereon or therefor.

BACKGROUND

The present invention relates to a fueldraulic actuator installation and removal tool. More specifically, but without limitation, the present invention is for use when performing maintenance on the F-35 fighter, specifically when removing and replacing the fueldraulic actuator.

A fueldraulic actuator is an apparatus in a jet engine which uses pressurized fuel to move the main thrust vectoring nozzle. In the F-35 military jet fighter, in order to replace the actuator an engine roll back must first be performed. This is due to the tight clearances inside the engine bay. An engine roll back requires parts of the engine and other related parts to be removed from the engine bay. This creates a long cycle time for replacing an actuator.

For the foregoing reasons, there is a need for a fueldraulic actuator installation and removal tool that allows quick and easy removal and replacement of the fuel actuator without performing an engine roll back.

SUMMARY

The present invention is directed to a fueldraulic actuator installation and removal tool that meets the needs enumerated above and below.

The present invention is directed to a fueldraulic actuator installation and removal tool that includes a base, an actuator chassis, and at least one articulating arm. The actuator chassis is able to communicate with a jet fueldraulic actuator located in a jet engine bay such that the actuator can be removed from the jet engine bay. The actuator chassis is connectable to the actuator at three predetermined points on the actuator. The at least one articulating arm, which is attached to the base, communicates with the actuator chassis such that the actuator chassis can be moved forward (frontwards) and backwards, left and right, oriented at different inclines, and adjusted to allow the actuator chassis to align and interface with the jet fueldraulic actuator.

It is a feature of the present invention to provide a fueldraulic actuator installation and removal tool that allows replacement of the actuator without performing an engine rollback.

It is a feature of the present invention to provide fueldraulic actuator installation and removal tool that reduces cycle time as well as man power required to maintain and replace the fueldraulic actuator.

DRAWINGS

These and other features, aspects and advantages of the present invention will become better understood with reference to the following description and appended claims, and accompanying drawings wherein:

DESCRIPTION

Figure 1:
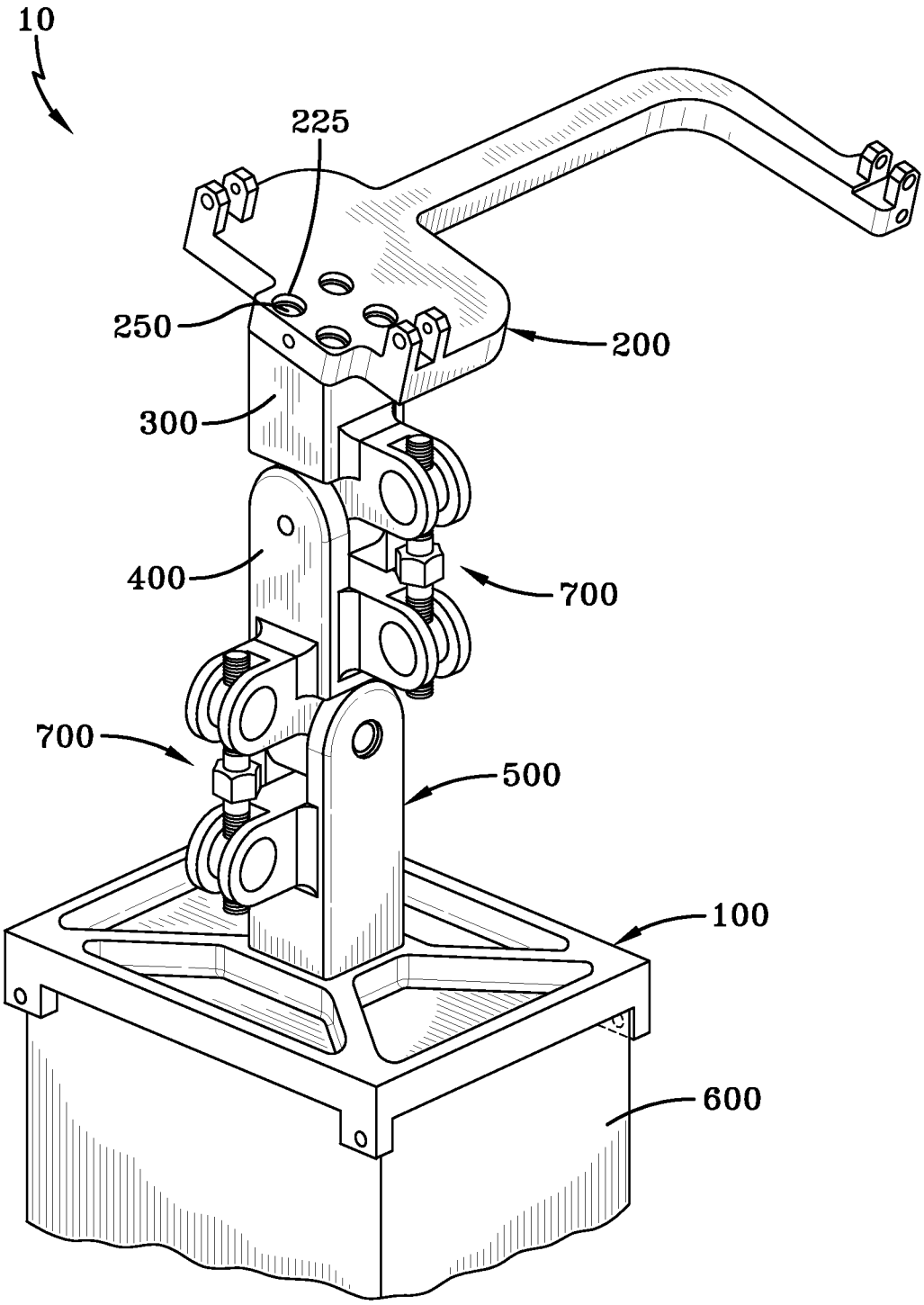
FIG. 1 is a perspective view of an embodiment of the fueldraulic actuator installation and removal tool.

The preferred embodiments of the present invention are illustrated by way of example below and in FIGS. 1-3. As shown in FIG. 1, the fueldraulic actuator installation and removal tool 10 includes a base 100, an actuator chassis 200, an inclined plane section 300, a first articulating arm 400, and a second articulating arm 500. The actuator chassis 200 is able to communicate with a jet fueldraulic actuator (not shown) located in a jet engine bay (not shown) such that the actuator can be removed from the jet engine bay. The actuator chassis 2000 is connectable to the actuator at three predetermined points on the actuator. The inclined plane section 300 communicates with the actuator chassis 200. As shown in FIG. 3, the inclined plane section 300 has an inclined portion 301. In particular, the actuator chassis 200 communicates with the inclined portion 301. The first articulating arm 400 communicates with the inclined plane section 300 such that the actuator chassis 200 can be moved left to right and adjusted to allow the actuator chassis 200 to align and interface with the jet fueldraulic actuator. The second articulating arm 500 communicates with the first articulating arm 400 such that the actuator chassis 200 to align and interface with the jet fueldraulic actuator. The second articulating arm 500 communicates with the base 100.

The base 100 is attachable to a universal jack 600 such that the tool 10 can be positioned by the universal jack 600. The universal jack 600 primarily moves the actuator chassis 200, as well as the tool 10, in an up and down motion.

Figure 2:
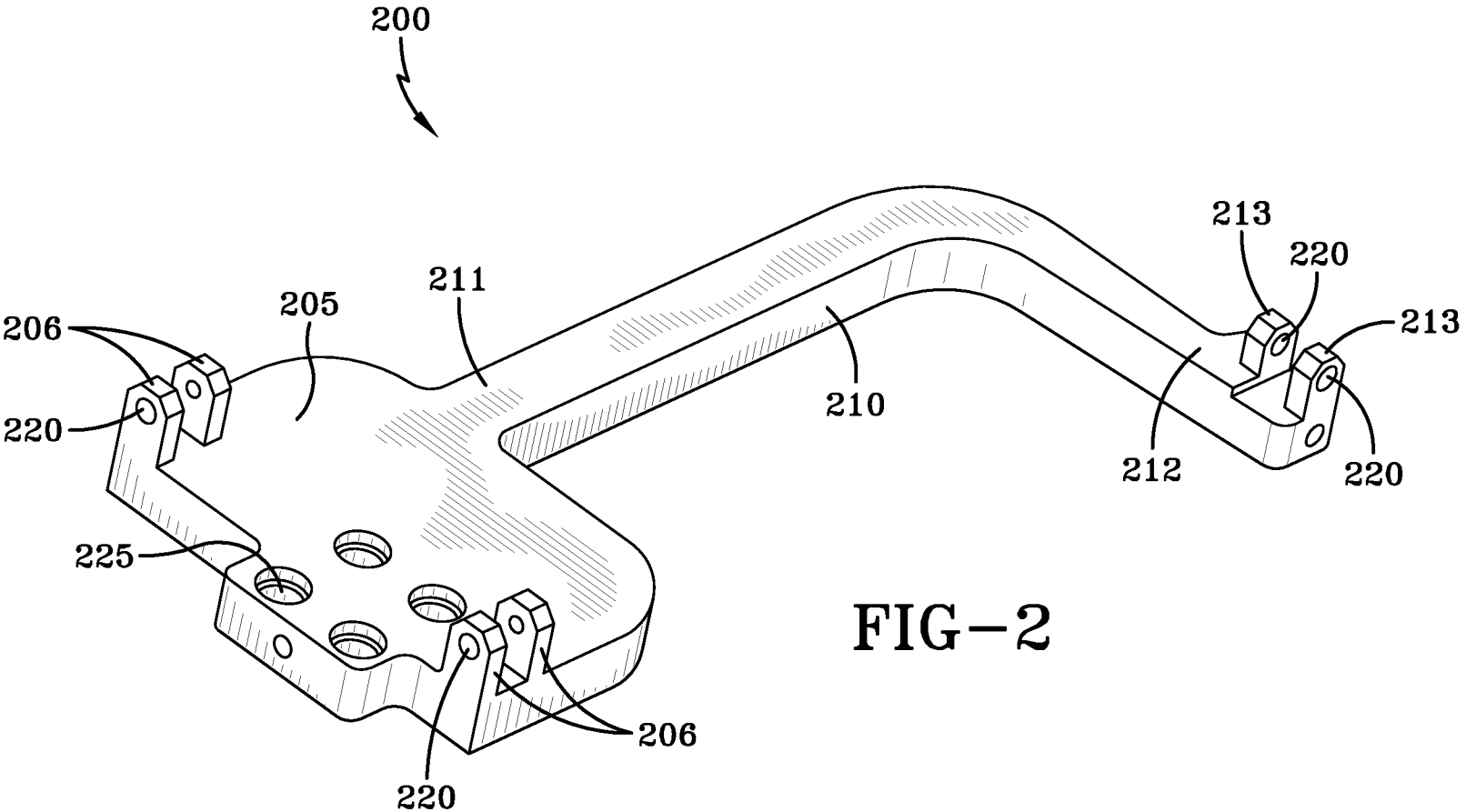
FIG. 2 is a perspective view of an embodiment of the actuator chassis.
Figure 3:
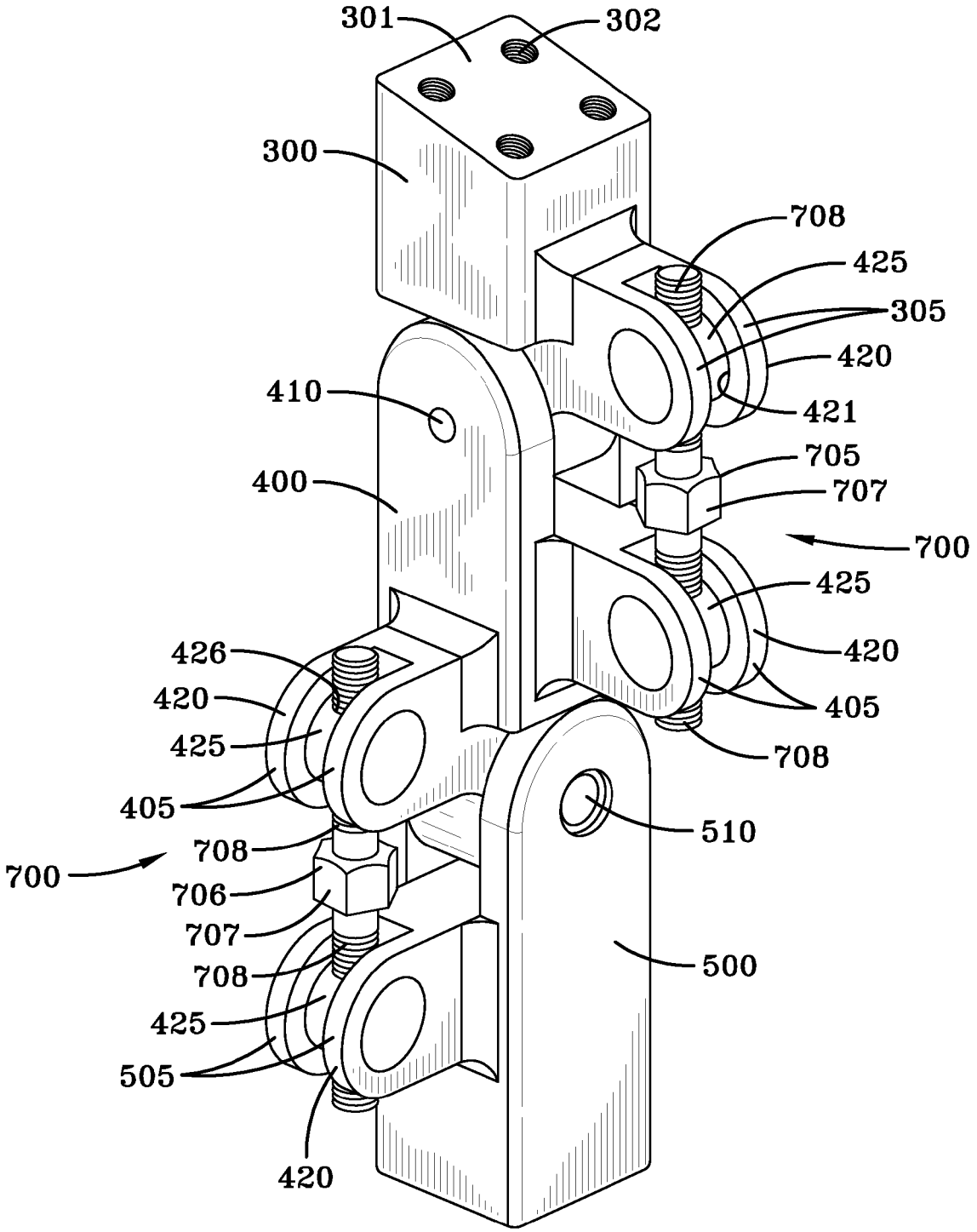
FIG. 3 is a perspective view of an embodiment of the inclined plane, the first articulating arm, the second articulating arm and the bushing-jack screw system.

As seen in FIG. 2, the actuator chassis 200 includes a plate 205 and an elbow 210 extending from the plate 205. As stated earlier, the three predetermined points on the actuator include a first point, a second point, and a third point. The plate 205 has two attachment points allowing attachment to two of the three predetermined points on the actuator. In the preferred embodiment, the plate 205 has two pairs of plate projections 206, each located at the first and the second points of attachment. The elbow 210 has a first end 211 and a second end 212. The first end 211 of the elbow 210 is attached to the plate 205, while the second end 212 of the elbow 210 has an elbow attachment point for attachment to the other predetermined point on the actuator. In the preferred embodiment, the elbow 210 has a pair of elbow projections 213 (located at the elbow attachment point) for attachment to the third point on the actuator. Each of the projections has a projection hole 220. For each pair of projections (each pair together can be deemed to be an actuator chassis bushing system), the projection holes 220 correspond such that a pin can correspond with the projection holes 220 and allow the actuator to be secured to the actuator chassis 200 at the predetermined points. The actuator chassis 200 may be manufactured from one continuous piece of metal. The actuator may be attached to the actuator chassis 200 via the plate projections 206 and elbow projections 213 utilizing steel pins.

In the preferred embodiment, the tool 10 includes a bushing-jack screw system 700 wherein the inclined plane section 300, the first articulating arm 400 and the second articulating arm 500 communicate with the bushing-jack screw system 700 such that locations of the first articulating arm 400 and the second articulating arm 500 can be moved such that the actuator chassis 200 location can be adjusted.

The preferred embodiment of the bushing-jack screw system 700 is described herein. The inclined plane section 300 has an inclined plane section pivot bushing system 305, the first articulating arm 400 has two first articulating arm pivot bushing systems 405, the second articulating arm 500 has a second articulating arm pivot bushing system 505. The tool further includes two adjustment jack screws—a first adjustment jack screw 705 and a second adjustment jack screw 706. The first adjustment jack screw 705 communicates with the inclined plane section pivot bushing system 305 and one of the first articulating arm pivot bushing systems 405 such that the actuator chassis 200 can be moved from left to right by manipulating the first adjustment jack screw 705. In the preferred embodiment, the inclined section pivot bushing system 305 is also pivotally attached to the first articulating arm 400 via a first pivot bolt 410. The second adjustment jack screw 706 communicates with other first articulating arm pivot bushing system 405 and the second articulating arm pivot bushing system 505 such that the actuator chassis 200 can be moved from font to back (frontwards and backwards) by manipulating the second adjustment jack screw 706. In the preferred embodiment, the other first articulating arm pivot bushing system 405 (the system communicating with the second articulating arm pivot bushing system 505) is also pivotally attached to the second articulating arm 500 via a second pivot bolt 510.

In the preferred embodiment, each pivot bushing system (305, 405, 505) includes a pair of corresponding rounded parallel bushing projections 420 with an arbor 425. Within each bushing system, the arbor 425 axially extends across from one corresponding bushing projection 420 to the other corresponding bushing projection 420, with each of the bushing projections 420 holding the arbor 425. The arbors 425 are cylindrical in shape with a threaded arbor hole 426. The arbor hole 426 is perpendicular to the cylindrical axis of the arbor 425. Each screw jack 705, 706 has two corresponding arbors 425 disposed within the communicating pivot bushing systems. For instance, the first adjustment jack screw 705 corresponds to the arbor 425 in the inclined plane section pivot bushing system 305 and the arbor 425 in one of the first articulating arm pivot bushing systems 405. The second adjustment jack screw 706 corresponds to the arbor 425 in the other first articulating arm pivot bushing system 405 and the arbor 425 in the second articulating arm pivot bushing system 505. For each jack screw, one arbor 425 in each corresponding arbor pair has a right hand threaded hole, the opposing arbor 425 has a reverse or left handed threaded hole. The cylindrical shape of the arbor 425 corresponds to a hole 421 that is bored in the corresponding bushing projections 420. Each screw jack 705, 706 has a middle section 707 with a hexagonal cross section shape. Axially extending from the middle section 707 are two partially threaded fingers 708 disposed on opposite ends of the middle section 707. All three arm axially aligned (all three axis lined up form a straight line). One finger 708 has a right handed thread and the other finger 708 has a left handed, or reverse thread. The fingers 708 are traded into the correspondingly threaded arbors holes 426. (Each finger 708 is threaded to a corresponding arbor 425.) When adjustment jack screw 706, 707 is turned the pivot bushings system are either pushed further apart or pulled closer together due to the interaction of the threads. This causes the actuator chassis 200 to move correspondingly.

As seen in FIG. 2, the plate 205 includes four plate holes 225 that correspond to fasteners 250 that connect the actuator chassis 200 to the inclined plane section 300. The incline plane section 300, particularly located on the inclined portion 301, has four corresponding inclined plane section holes 302 for accepting the fasteners 250. The fasteners 250 can be screws, bolts, dowels, or any type of fasteners that are practicable.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred embodiments thereof, other embodiments are possible. Therefore, the spirit and scope of the appended claims should not be limited to the description of the preferred embodiment(s) contained herein.

What is claimed is:

1. A fueldraulic actuator installation and removal tool comprising:

a base;

an actuator chassis, the actuator chassis able to communicate with a jet fueldraulic actuator located in a jet engine bay such that the actuator can be removed from the jet engine bay, the actuator chassis connectable to the actuator at three predetermined points on the actuator, the actuator chassis includes a plate and an elbow extending from the plate, the three predetermined points being a first point, a second point and a third point, the plate having two pairs of plate projections that allow attachment to the first point and the second point to the actuator, the elbow having a first end and a second end, the first end attached to the plate, the second end having a pair of elbow projections for attachment to the third point on the actuator and, at least one articulating arm communicating with the actuator chassis such that the actuator chassis can be moved frontwards and backwards and left and right, and oriented at different inclines and adjusted to allow the actuator chassis to align and interface with the jet fueldraulic actuator, the at least one articulating arm attached to the base.

2. The fueldraulic actuator installation and removal tool of claim 1, wherein the base is attachable to a universal jack such that the tool can be positioned by the universal jack.

3. The fueldraulic actuator installation and removal tool of claim 2, wherein the at least one articulating arm has a pivot bushing system, the pivot bushing system communicating with an adjustment jack screw that can adjust the location of the at least one articulating arm such that the actuator chassis location can be adjusted.

4. A fueldraulic actuator installation and removal tool comprising:

a base;

an actuator chassis, the actuator chassis able to communicate with a jet fueldraulic actuator located in a jet engine bay such that the actuator can me removed from the jet engine bay, the actuator chassis connectable to the actuator at three predetermined points on the actuator, the actuator chassis includes a plate and an elbow extending from the plate, the plate having two attachment points allowing attachment to two of the three predetermined points on the actuator, the elbow having a first end and a second end, the first end attached to the plate, the second end having an elbow attachment point for attachment to the other predetermined point on the actuator;

an inclined plane section communicating with the actuator chassis;

a first articulating arm communicating with the inclined plane section such that the actuator chassis can be moved left to right and adjusted to allow the actuator chassis to align and interface with the jet fueldraulic actuator; and a second articulating arm communicating with the first articulating arm and the base such that the actuator chassis can be moved forward and backward and adjusted to allow the actuator chassis to align and interface with the jet fueldraulic actuator.

5. The fueldraulic actuator installation and removal tool of claim 4, wherein the base is attachable to a universal jack such that the tool can be positioned by the universal jack.

6. The fueldraulic actuator installation and removal tool of claim 5, wherein the tool includes a bushing-jack screw system wherein the inclined plane section, the first articulating arm and the second articulating arm communicate with the bushing-jack screw system such that locations of the first articulating arm and the second articulating arm can be moved such that the actuator chassis location can be adjusted.

7. The fueldraulic actuator installation and removal tool of claim 5, wherein the inclined plane section has an inclined plane section pivot bushing system, the first articulating arm has two first articulating arm pivot bushing systems, the second articulating arm has a second articulating arm pivot bushing system, the tool further has two adjustment jack screws, one adjustment jack screw communicating with the inclined plane section pivot bushing system and one of the first articulating arm pivot bushing systems such that the actuator chassis can be moved left to right, the other adjustment jack screw communicating with the other first articulating arm pivot bushing system and the second articulating arm pivot bushing system such that the actuator chassis can be moved frontwards to backwards.

8. The fueldraulic actuator installation and removal tool of claim 7, wherein the actuator chassis has three actuator chassis bushing systems, each actuator chassis bushing system located at a location corresponding to each one of the three predetermined points.

9. The fueldraulic actuator installation and removal tool of claim 8, wherein the plate includes four holes that correspond to fasteners that connect the actuator chassis to the inclined plane section.

* * * * *